US005740253A

United States Patent [19]

Takeuchi

[11] Patent Number: 5,740,253

[45] Date of Patent: Apr. 14, 1998

[54] STEROPHONIC SOUND FIELD EXPANSION DEVICE

[75] Inventor: Eiji Takeuchi, Hamamatsu, Japan

[73] Assignee: Yamaha Corporation, Japan

[21] Appl. No.: 638,494

[22] Filed: Apr. 26, 1996

[30] Foreign Application Priority Data

Apr. 28, 1995 [JP] Japan ..... 7-129477

[51] Int. Cl.[6] ..... H04R 5/00

[52] U.S. Cl. ..... 381/1; 381/63

[58] Field of Search ..... 381/1, 63, 24, 381/17, 61; 84/630

[56] References Cited

U.S. PATENT DOCUMENTS 4,980,914 12/1990 Kunugi et al. ..... 381/63

*Primary Examiner*—Curtis Kuntz

*Assistant Examiner*—Vivian Chang

*Attorney, Agent, or Firm*—Graham & James LLP

[57] ABSTRACT

A stereophonic sound field generation device includes a left side localized reflected sound generation circuit which generates a left channel reflected sound signal and a left channel cancel signal for realizing an outside-of-speaker localization of the left channel reflected sound signal. The left side localized reflected sound generation circuit includes a delay circuit and a coefficient generator. By variously setting delay time of the delay circuit 140 and multiplication coefficient of the coefficient generator with respect to each reflected sound, at least one reflected sound in a broad listenable range can be localized in a space outside of a left channel speaker even when a listener moves his listening position. The stereophonic sound field expansion device includes also a right side localized reflected sound generation circuit which is of the same construction as the left side localized reflected sound generation circuit and at least one reflected sound can be localized in a space outside of a right channel speaker.

8 Claims, 9 Drawing Sheets

STEROPHONIC SOUND FIELD EXPANSION DEVICE

BACKGROUND OF THE INVENTION

This invention relates to a device for simulating reflected sounds in a concert hall or the like and, more particularly, to a device of this type enabling a listener to perceive expansion of a sound field by localizing reflected sounds in a space outside of a space in front of and between speakers provided on the front left and front right sides of the listener. More particularly, the invention relates to a device of this type capable of securing a broad range of expansion of the sound field.

For simulating reflected sounds in a sound field such as a concert hall in a home room or the like, there is a prior art four-channel sound field processing system as shown in FIG. 2. In this system, four speakers 14 (front left), 15 (front right), 16 (rear left) and 17 (rear right) are provided about a listener 12. Two-channel (left and right) input stereophonic tone signals L and R (it is assumed that these input tone signals are digital signals) are imparted with proper multiplication coefficients (i.e., gain) by coefficient generators 18 and 20, added together by an adder 22 and thereafter a sum signal L+R is applied to a reflected sound signal generation circuit 24.

In the reflected sound signal generation circuit 24, a front localized reflected sound generation circuit 26 generates reflected sounds which are localized in the front of the listener 12 (i.e., between the speakers 14 and 15). In the front localized reflected sound generation circuit 26, the sum signal L+R of the left channel and right channel input signals is sequentially delayed by a delay circuit 28 by using a predetermined clock and delay signals are respectively provided from taps corresponding to delay times of the respective reflected sounds to be produced (i.e., delay times to the direct sound). The delay signals then are imparted, for the respective reflected sounds, with multiplication coefficients by the coefficient generators 30 and 32 to adjust their level (tone volume) and left-right balance (i.e., a position at which a sound image is localized between the speakers 14 and 15). The delay signals of the left channel are added together by an adder 34 to form a front left reflected sound signal FL1 and the delay signals of the right channel are added together by an adder 36 to form a front right reflected sound signal FR1.

A left side localized reflected sound generation circuit 38 generates reflected sounds which are localized on the left side of the listener 12 (i.e., between the speakers 14 and 16). In the left side localized reflected sound generation circuit 38, the sum signal L+R is sequentially delayed by a delay circuit 40 by using a predetermined clock and delay signals are provided from taps corresponding to delay times of the respective reflected sounds to be produced. The delay signals are imparted, for the respective reflected sounds, with multiplication coefficients by coefficient generators 42 and 44 to adjust their level and front-rear balance (i.e., a position at which a sound image is localized between the speakers 14 and 16). The delay signals of the front channel are added together by an adder 46 to form a front left reflected sound signal FL2 and the delay signals of the rear channel are added together by an adder 48 to form a rear left reflected sound signal RL1.

A rear localized reflected sound generation circuit 50 generates reflected sounds which are localized in the rear of the listener 12 (i.e., between the speakers 16 and 17). In the rear localized reflected sound generation circuit 50, the sum signal L+R is sequentially delayed by a delay circuit 52 and delay signals are provided from taps corresponding to delay times of the respective reflected sounds to be produced. The delay signals are imparted, for the respective reflected sounds, with multiplication coefficients by coefficient generators 54 and 56 to adjust their level and left-right balance (i.e., a position at which a sound image is localized between the speakers 16 and 17). The delay signals of the left channel are added together by an adder 58 to form a rear left reflected sound signal RL2 and the delay signals of the right channel are added together by an adder 60 to form a rear right reflected sound signal RR1.

A right side localized reflected sound generation circuit 62 generates reflected sounds which are localized on the right side of the listener 12 (i.e., between the speakers 15 and 17). In the right side localized reflected sound generation circuit 62, the sum signal L+R is sequentially delayed by a delay circuit 64 by using a predetermined clock and delay signals are provided from taps corresponding to delay times of the respective reflected sounds to be produced. The delay signals are then imparted, for the respective reflected sounds, with multiplication coefficients by coefficient generators 66 and 68 to adjust their level and left-right balance (i.e., a position at which a sound image is localized between the speakers 15 and 17). The delay signals of the left channel are added together by an adder 70 to form a front right reflected sound signal FR2 rand the delay signals of the right channel are added together by an adder 72 to form a rear right reflected sound signal RR2.

The direct sound L and the reflected sounds FL1 and FL2 to be reproduced from the front left speaker 14 are added together by an adder 74 and the sum signal is converted to an analog signal by a digital-to-analog converter 76 and is reproduced by the front left speaker 14 through a low-pass filter 78 and an amplifier 80. The direct sound R and the reflected sounds FR1 and FR2 to be reproduced by the front right speaker 15 are added together by an adder 82 and the sum signal is converted to an analog signal by a digital-to-analog converter 84 and is reproduced by the front right speaker 15 through a low-pass filter 86 and an amplifier 88. The reflected sounds RL1 and RL2 to-be reproduced by the rear left speaker 16 are added together by an adder 90 and the sum signal is converted to an analog signal by a digital-to-analog converter 92 and is reproduced by the rear left speaker 16 through a low-pass filter 94 and an amplifier 96. The reflected sounds RR1 and RR2 to be reproduced by the rear right speaker 17 are added together by an adder 98 and converted to an analog signal by a digital-to-analog converter 100 and the sum signal is reproduced by the rear right speaker 17 through a low-pass filter 102 and an amplifier 104.

According to the four-channel sound field processing system of FIG. 2, a reflected sound field surrounding the listener 12 (i.e., in a range of 360 degrees about the listener 12) can be simulated and, therefore, a sound field which is closely similar to a real sound field of a concert hall etc. can be realized. According to this system, however, four speakers are required for realizing the four- channel sound field processing and this poses difficulties in the manufacturing cost and also in the space for placing the device in a case where the device is mounted on a low cost, compact size stereophonic component set or a game machine.

For overcoming the problem, there has been proposed a two-channel sound field processing system as shown in FIG. 3 which is a simplified design of the system of FIG. 2. According to this two-channel system, the front localized reflected sound generation circuit only is used among the structure of the four-channel system of FIG. 2 and front localized reflected sounds are reproduced by the front left and front right speakers 14 and 15. This two-channel sound field processing system is convenient in that it can be adopted readily for a low-cost, compact size stereophonic component set or a game machine. In this system, however, reflected sounds are localized only in a narrow space between the front left and front right speakers 14 and 15 and, as a result, feeling of expansion of a sound field to one surrounding the listener 12 cannot be obtained.

A sound field processing system proposed by Japanese Patent Application No. 70814/1993 attempts to produce feeling of expansion of a sound field to one surrounding a listener with two-channel speakers disposed at front left and front right positions. According to this system, two-channel speakers are placed on the front left and front right sides of a listener, direct sounds of left and right channels are added to reflected sounds to be reproduced from the front left and front right speakers for each of the left and right channels and sum signals are reproduced from the front left and front right speakers and, simultaneously, reflected sounds to be reproduced in the rear of the listener are made opposite-phase to each other and the opposite-phase reflected sounds are reproduced from the front left and front right speakers. By making the phases of the reflected sounds to be reproduced in the rear of the listener opposite to each other and reproducing the opposite-phase reflected sounds on the left and right sides of the listener, an "in-head" localization (the phenomenon that a sound image is felt to exist about the listener's head) can be produced and, accordingly, a rear sound field can be simulated and feeling of expansion of a sound field to one surrounding the listener can thereby be produced with only the two-channel speakers placed in the front of the listener. It is, however, owing to feeling of non-localized reflected sounds that the feeling of expansion of the sound field is produced. Accordingly, it is only between the front two-channel speakers that a clearly localized reflected sound field can be produced and it is not possible by this system to reproduce feeling of expansion of a sound field which closely simulates a real sound field such as one in a concert hall.

An outside-of-speaker localization system according to which a sound image can be localized in a space outside of a space in front of and between speakers by utilizing two-channel .front speakers is disclosed by, e.g., Japanese Patent Application Laid-open No. Hei 5-41900. In this system, as shown in FIG. 4, speakers 14 and 15 are disposed on the front left and front right sides of a listener 12 to reproduce left and right two-channel stereophonic signals L and R. Further, the left channel signal L is delayed by a small length of time by a delay circuit 110 and attenuated in its gain to a predetermined value and inverted in its phase by a coefficient generator 112 to produce a left channel cancel signal. This left channel cancel signal is added to the right channel signal R by an adder 114 and is reproduced by the right channel speaker 15. Likewise, the right channel signal R is delayed by a small length of time by a delay circuit 116 and is attenuated in its gain to a predetermined value and is inverted in its phase by a coefficient generator 118 to produce a right channel cancel signal. This right channel cancel signal is added to the left channel signal L by an adder 120 and is reproduced by the left channel speaker 14.

According to this system, a cross talk which is produced by detouring of the left channel signal L reproduced by the left channel speaker 14 to the right ear of the listener 12 is cancelled by left channel cancel signal reproduced by the right channel speaker 15 whereby feeling as if the speaker 14 moved to the left side of the listener 12 as shown by reference characters 14' is produced. Likewise, a cross talk produced by detouring of the right channel signal R reproduced by the right channel speaker 15 to the left ear of the listener 12 is cancelled by the right channel cancel signal reproduced by the left channel speaker 14 whereby feeling as if the right side speaker 15 moved to the right side of the listener 12 as shown by reference character 15' is produced. By this arrangement, sounds reproduced from the speakers 14 and 15 can be localized in a space outside of a space between the speakers 14 and 15 (i.e., at a position between the hypothetical speakers 14' and 15') and the outside-of-speaker localization thereby is realized.

It is conceivable to combine this outside-of-speaker localization system with the two-channel sound field processing system shown in FIG. 3 and thereby provide a system as shown in FIG. 5 in which sound images of reflected sounds are localized in a space outside of a space between the speakers 14 and 15 thereby to produce feeling of expansion of a sound field produced by the two-channel sound field processing system. Since, however, optimum values of delay time of delay circuits 110 and 116 and coefficients of coefficient generators 112 and 118 for realizing a stable outside-of-speaker localization vary depending upon factors such as-the listening position of the listener, the cross talk cancelling effect will no longer be obtained if the listener 12 changes the listening position and, therefore, expansion of a sound field of reflected sounds outside of the speakers 14 and 15 will no longer be available. For this reason, the listenable range (i.e., a range of space in which the outside-of-speaker localization can be stably obtained) in this system is extremely narrow. Further, difference in ear characteristics (i.e., acoustic characteristics of a human ear) between individuals is so great that, even if delay times and multiplication coefficients are set according to one listener for providing an optimum outside-of-speaker localization, such setting of delay times and multiplication coefficients does not necessarily provide an optimum outside-of-speaker localization to another listener.

It is, therefore, an object of the present invention to provide a stereophonic sound field expansion device enabling a listener to perceive expansion of a sound field by localizing reflected sounds in a space outside of a space in front of and between speakers provided on the front left and front right sides of the listener, securing a broad listenable range in which expansion of a sound field can be perceived, and minimizing the effect of difference in the ear characteristics between individuals.

SUMMARY OF THE INVENTION

For achieving the above described object of the invention, there is provided a stereophonic sound field expansion device comprising left channel reflected sound signal generation means for generating left channel reflected sound signals of an input tone signal having different delay times and different levels; right channel reflected sound signal generation means for generating right channel reflected sound signals of an input tone signal having different delay times and different levels; left channel cancel signal generation means for generating left channel cancel signals by delaying the left channel reflected sound signals individually with delay times which enable localization of the respective left channel reflected sound signals at different listening points determined for the respective left channel reflected sound signals in a space outside of a space in front of and between speakers and by inverting phase of the respective left channel reflected sound signals; right channel cancel signal generation means for generating right channel cancel signals by delaying the right channel reflected sound signals individually with delay times which enable localization of the respective right channel reflected sound signals at different listening points determined for the respective right channel reflected sound signals in a space outside of a space in front of and between speakers and by inverting phase of the respective right channel reflected sound signals; a left channel speaker provided on the front left side of a listening position of a listener for reproducing the left channel reflected sound signals and the right channel cancel signals; and a right channel speaker provided on the front right side of the listening position for reproducing the right channel reflected sound signals and the left channel cancel signals.

According to the invention, delay times of the cancel signals cancelling cross talk of reflected sound signals are set at values which enable an outside-of-speaker localization of the respective reflected sound signals at different listening points determined for the respective reflected sound signals. By this arrangement, when the listening point is moved, the cross talk cancelling effect is reduced with respect to a part of reflected sounds but the cross talk cancelling effect is enhanced with respect to other reflected sounds to thereby produce the outside-of-speaker localization. In a case where reflected sounds in a certain environment, e.g., a concert hall, are simulated, the listener does not discriminate each reflected sound individually but perceives a bundle of reflected sounds collectively and, for this reason, a localized position of each individual reflected sound is not considered so important. In other words, even though a localized position of each individual reflected sound may differ depending upon the ear characteristic or listening point of the listener, feeling of expansion can be obtained in the simulation of reflected sounds so long as an outside-of-speaker localization is obtained with respect to a part of the reflected sounds and, as a result, the listenable range (a range of space in which feeling of expansion by an outside-of-speaker localization can be obtained) is expanded and the effect of difference in the ear characteristic between individuals can be mitigated.

In one aspect of the invention, a stereophonic sound field expansion device further comprises attenuation means for attenuating the left channel cancel signals with multiplication coefficients which enable a clearer localization of the respective left channel reflected sound signals at the respective listening points determined for the respective left channel reflected sound signals in the space outside of the space in front of and between the speakers and; attenuation means for attenuating right channel cancel signals with multiplication coefficients which enable a clearer localization of the respective right channel reflected sound signals at the respective listening points determined for the respective right channel reflected sound signals in the space outside of the space in front of and between the speakers.

According to this aspect of the invention, the multiplication coefficients of the cancel signals are set at values at which a clearer outside-of-speaker localization of the respective reflected sound signals at the respective listening points can be obtained and, therefore, the outside-of-speaker localization of reflected sounds can be made clearer.

In another aspect of the invention, a stereophonic sound field expansion device further comprises front reflected sound signal generation means for generating front reflected sound signals of an input signal having different delay times and different levels, said front reflected sound signals being reproduced by said left channel speaker and said right channel speaker.

According to this aspect of the invention, the front reflected sound signals are separately produced and reproduced by the left and right speakers and, therefore, reflected sounds can be localized at various positions in a broad range from the front to the left and right sides of the listener with the left and right speakers.

In another aspect of the invention, a stereophonic sound field expansion-device further comprises input signal combining means for combining an input left channel tone signal and an input right channel tone signal together to form an input tone signal to be supplied to the left channel reflected sound signal generation means and the right channel reflected sound signal generation means.

In another aspect of the invention, in a stereophonic sound field expansion device as defined, the input tone signal applied to said left channel reflected sound signal generation means is a left channel input tone signal and the input tone signal applied to said right channel reflected sound signal generation means is a right channel input tone signal.

According to this aspect of the invention, a more intense feeling of expansion of a sound field can be obtained.

In another aspect of the invention, a stereophonic sound field expansion device as defined further comprises input signal combining means for combining an input left channel tone signal and an input right channel tone signal together to form an input tone signal to be supplied to the left channel reflected sound signal generation means and the right channel reflected sound signal generation means.

In another aspect of the invention, in a stereophonic sound field expansion device, the input tone signal applied to said left channel reflected sound signal generation means is a left channel input tone signal and the input tone signal applied to said right channel reflected sound signal generation means is a right channel input tone signal.

In still another aspect of the invention, in a stereophonic sound field expansion device, the front reflected sound signals to be reproduced by the left channel speaker have the same delay time as the front reflected sound signals to be reproduced by the right channel speaker and have a different level from the front reflected sound signals to be reproduced from the right channel speaker.

For producing the cancel signals, it is not always necessary to set different delay time and multiplication coefficient for each individual reflected sound (i.e., to assume a different listening point for each individual reflected sound) but cancel signals for plural reflected sounds may exist for a single listening point.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Embodiment 1

Figure 1:
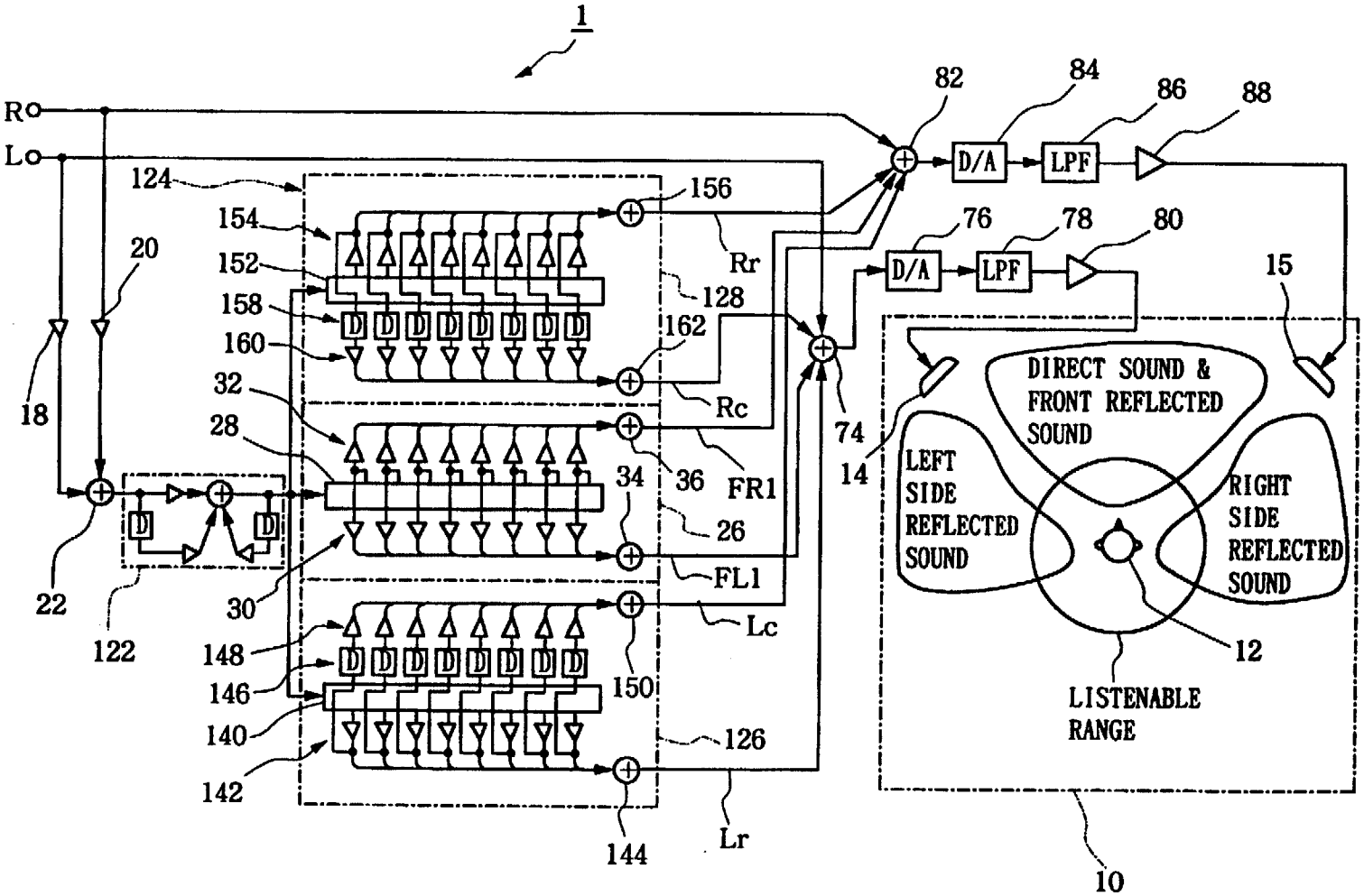
FIG. 1 is a block diagram showing an embodiment of the invention.
Figure 2:
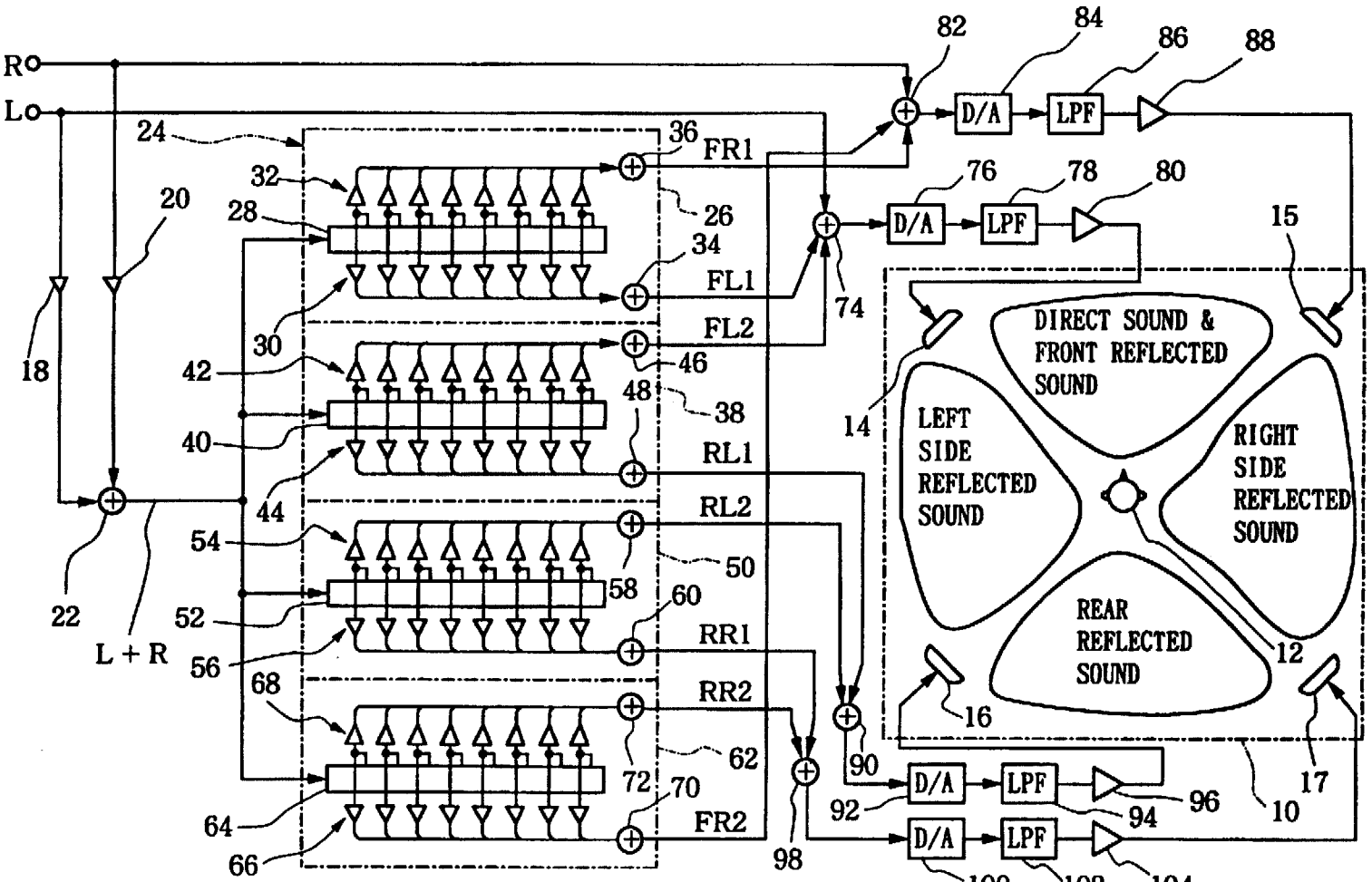
FIG. 2 PRIOR ART
FIG. 2 is a block diagram showing an example of a prior art four-channel sound field processing system.
Figure 3:
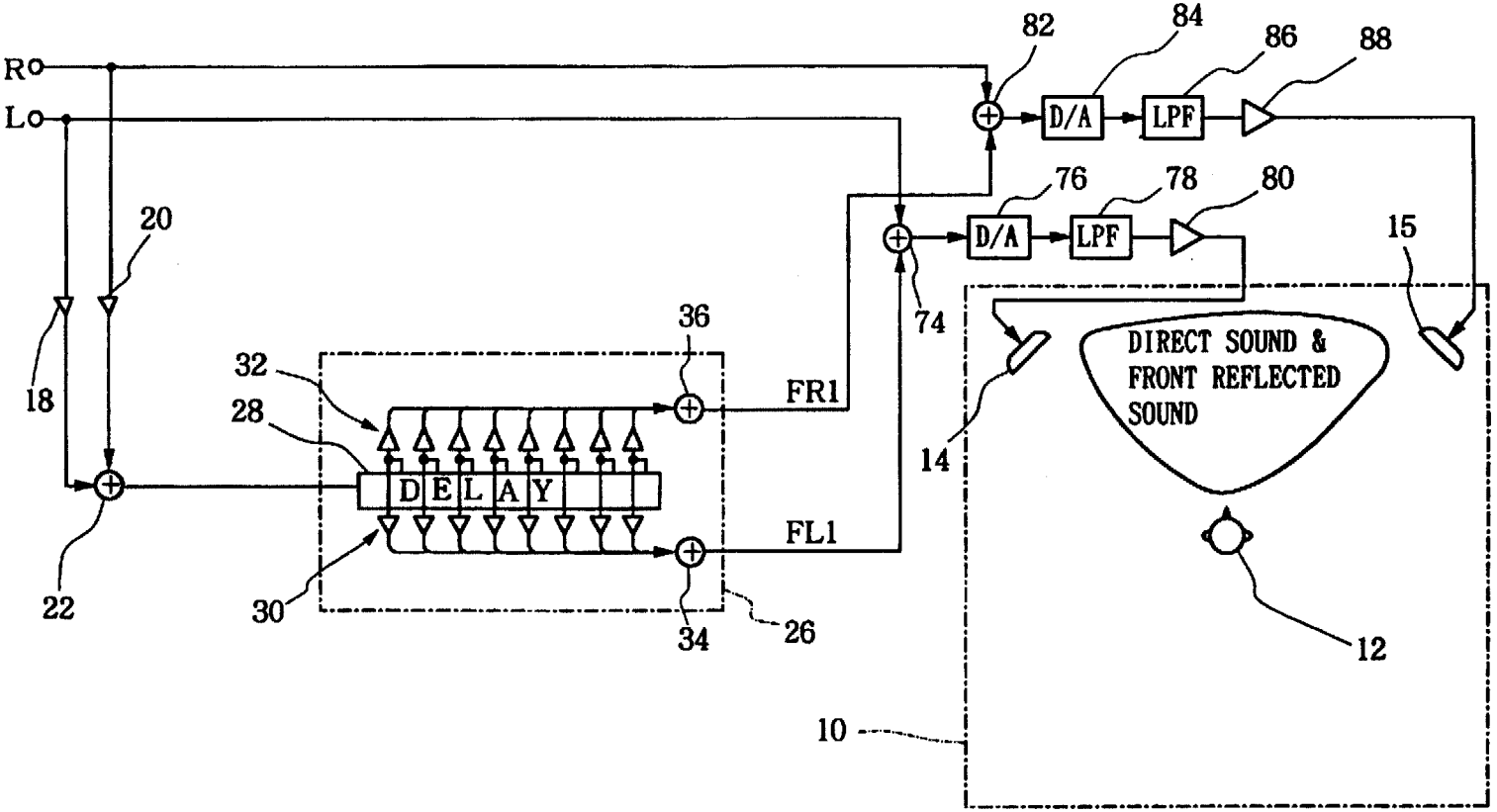
FIG. 3 PRIOR ART
FIG. 3 is a block diagram showing a prior art two-channel sound field processing system.
Figure 4:
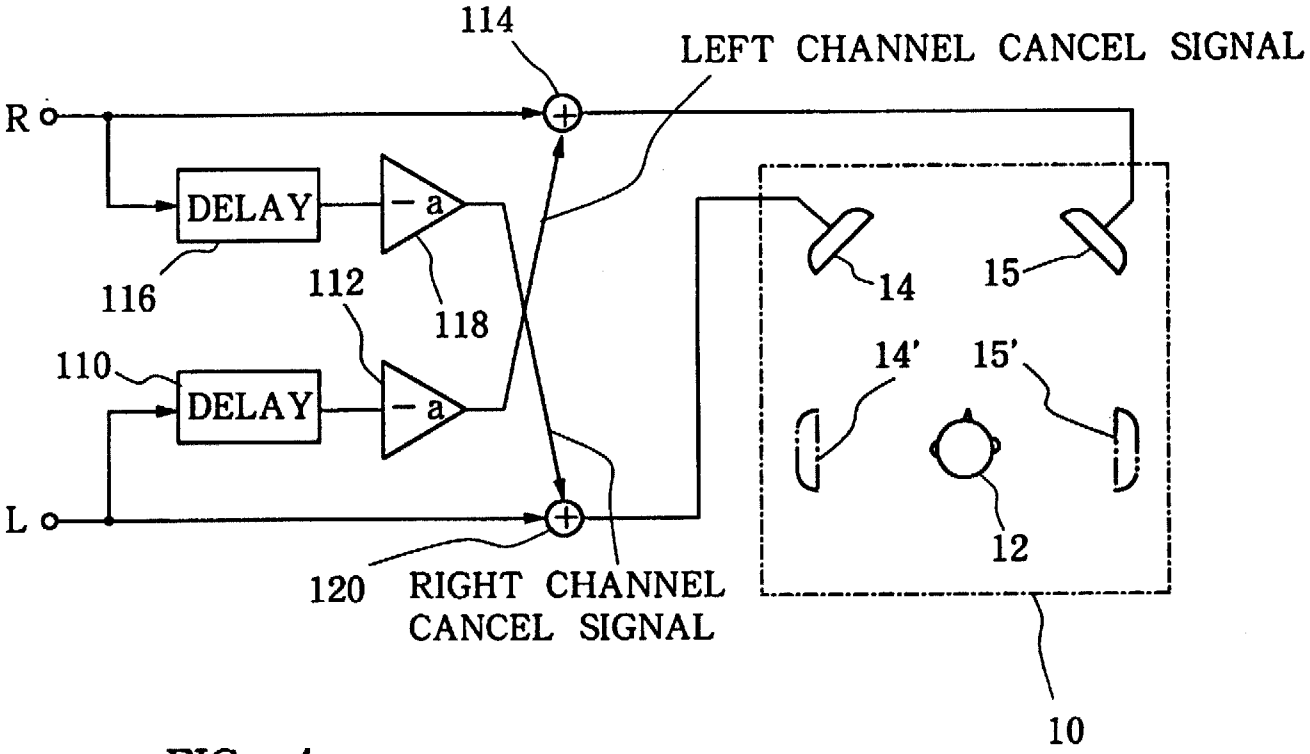
FIG. 4 PRIOR ART
FIG. 4 is a block diagram showing a prior art outside-of-speaker localization system by cancelling a cross talk.
Figure 5:
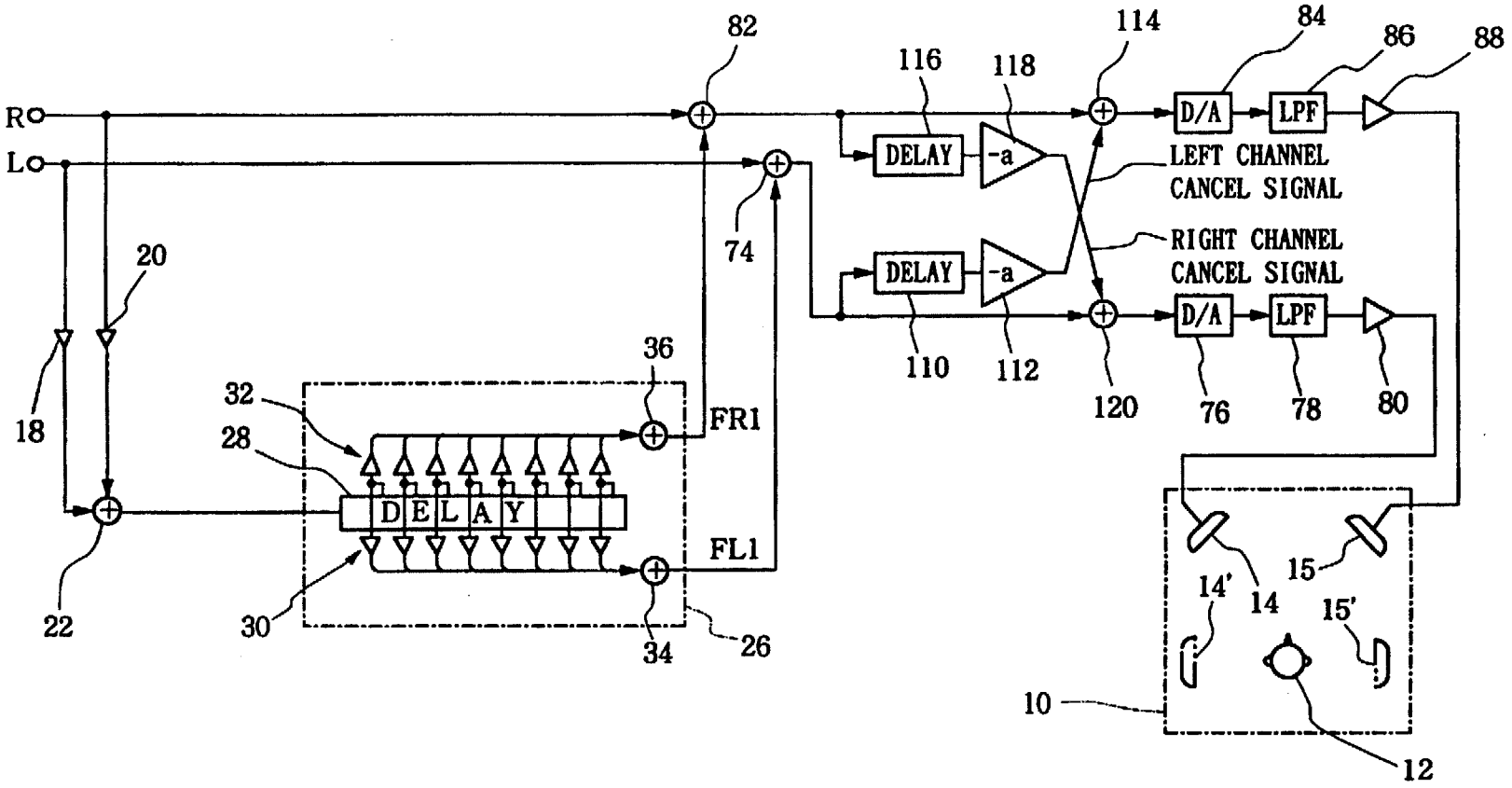
FIG. 5 is a block diagram showing a system for realizing an outside-of-speaker localization by combining the outside-of-speaker localization system of FIG. 4 with the two-channel sound field processing system of FIG. 2.

FIG. 1 shows an embodiment of the invention. In FIG. 1, the same component parts as those shown in FIGS. 2 and 3 are designated by the same reference characters.

In a chamber 10, there are provided two speakers 14 (front left) and 15 (front right) on the front left and front right sides of a listener 12. Left and right channel two-channel stereophonic tone signals L and R (it is assumed that these signals are digital signals) applied to a stereophonic sound field expansion device 1 are imparted with proper multiplication coefficients (i.e., gain) by coefficent generators 18 and 20 and added by an adder 22. A sum signal is applied to a low-pass filter 122. The low-pass filter 122 is provided for mitigating a condition of localization by narrowing the frequency band of the tone signal and thereby facilitating adjustment of localization of a reflected sound image in a space outside of a space in front of and between the speakers 14 and 15 so as to localize the reflected sound image in the space outside of the speakers 14 and 15 and also for preventing separation of a sound depending upon the frequency band for stabilizing the width of localization of the reflected sound image in the space outside of the speakers 14 and 15, and further for giving naturalness to simulated reflected sounds. The cut-off frequency of the low-pass filter 122 is set at a value in the order of e.g., 8 kHz. The filter used here is not limited to the low-pass filter but any type of filter such as a band-pass filter may be used so long as it has a function of stabilizing localization of a reflected sound image by adjusting the frequency band of the tone signal.

The tone signal provided by the low-pass filter 122 is applied to a reflected sound signal generation circuit 124. In the reflected sound signal generation circuit 124, a front localized reflected sound generation circuit 26 generates reflected sounds which are localized in the front of the listener 12 (i.e., between the speakers 14 and 15). In the front localized reflected sound generation circuit 26, the sum signal L+R of the left channel and right channel input signals is sequentially delayed by a delay circuit 28 by using a predetermined clock and delay signals are respectively provided from taps corresponding to delay times of the respective reflected sounds to be produced (i.e., delay times to the direct sound). The delay signals then are imparted, for the respective reflected sounds, with multiplication coefficients by the coefficient generators 30 and 32 to adjust their level (tone volume) and left-right balance (i.e., a position at which a sound image is localized between the speakers 14 and 15). The delay signals of the left channel are added together by an adder 34 to form a front left reflected sound signal FL1 and the delay signals of the right channel are added together by an adder 36 to form a front right reflected sound signal FR1.

A left side localized reflected sound generation circuit 126 and a right side localized reflected sound generation circuit 128 are provided for generating reflected sounds which are localized on the left side and right side of the listener 12. The principle of localization by these circuits will now be described.

Figure 6A:
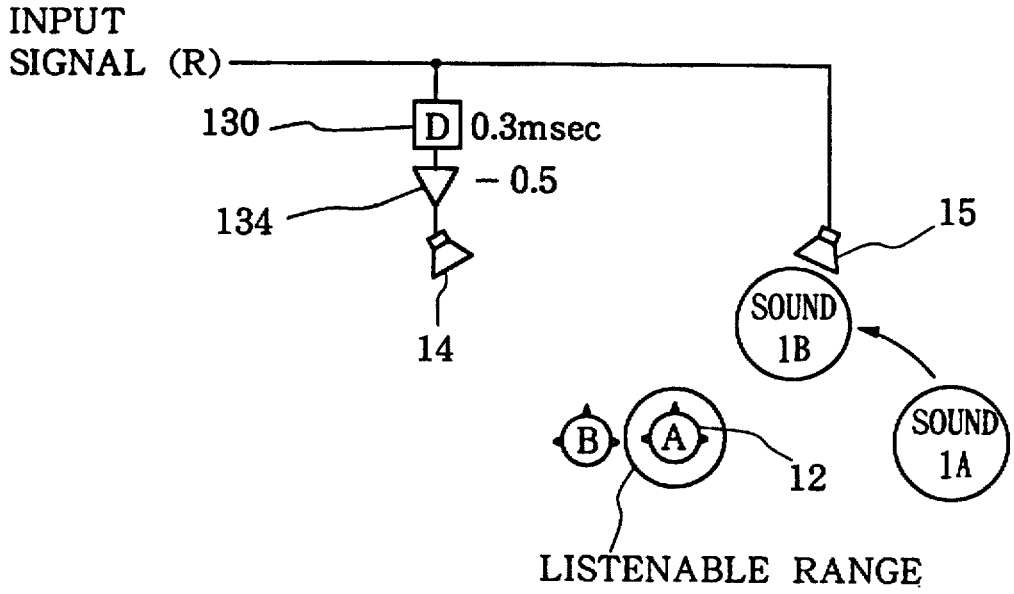
FIGS. 6A and 6B are diagrams for explaining the principle of the present invention.

Referring now to FIG. 6A, it is assumed that the right channel signal R is reproduced by the right side speaker 15 and this right channel signal R is also delayed by a delay circuit 130 by a short length of time and then attenuated to a predetermined gain and inverted in its phase by a coefficient generator 132 and thereafter is reproduced by the left side speaker 14. In this case, a sound which is reproduced by the right side speaker 15 and reaches the left ear of the listener 12 (i.e., cross talk) is cancelled by a sound reproduced by the left side speaker 14 (i.e., a cross talk cancel signal) whereby a sound image can be localized in a space outside of a space in front of and between the speakers 14 and 15 (i.e., an outside-of-speaker localization of a sound image by cancelling of cross talk).

It is assumed now that the listener 12 is located at a listening position A and a sound image has been localized at a position designated as SOUND 1A which is outside of the speaker 15 by adjusting delay time of the delay circuit 130 and multiplication coefficient of the coefficient generator 132. If the listener 12 then moves to a listening position B while the delay time and the multiplication coefficient remain unchanged, the sound which has been located at SOUND 1A may then be localized at SOUND 1B and this will no longer be an outside-of-speaker localization. If, however, the delay time and multiplication coefficient are adjusted to the listening position B, the sound image will be localized in a space outside of the speaker 15.

Figure 6B:
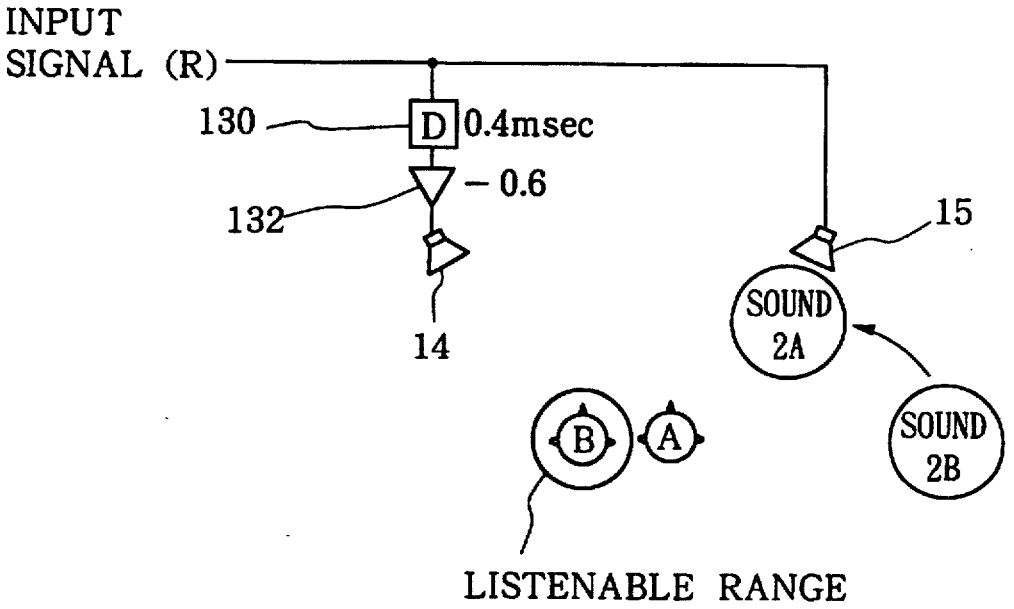

It is now assumed that, as shown in FIG. 6B, a sound image has been localized at a position designated as SOUND 2B which is outside of the speaker 15 by adjusting the delay time and multiplication coefficient when the listener 12 is at the listening position B. If the listening position is changed to the position A while the delay time and multiplication coefficient remain unchanged, the sound image will move from SOUND 2B to, e.g., SOUND 2A.

Figures 7A, 7B:
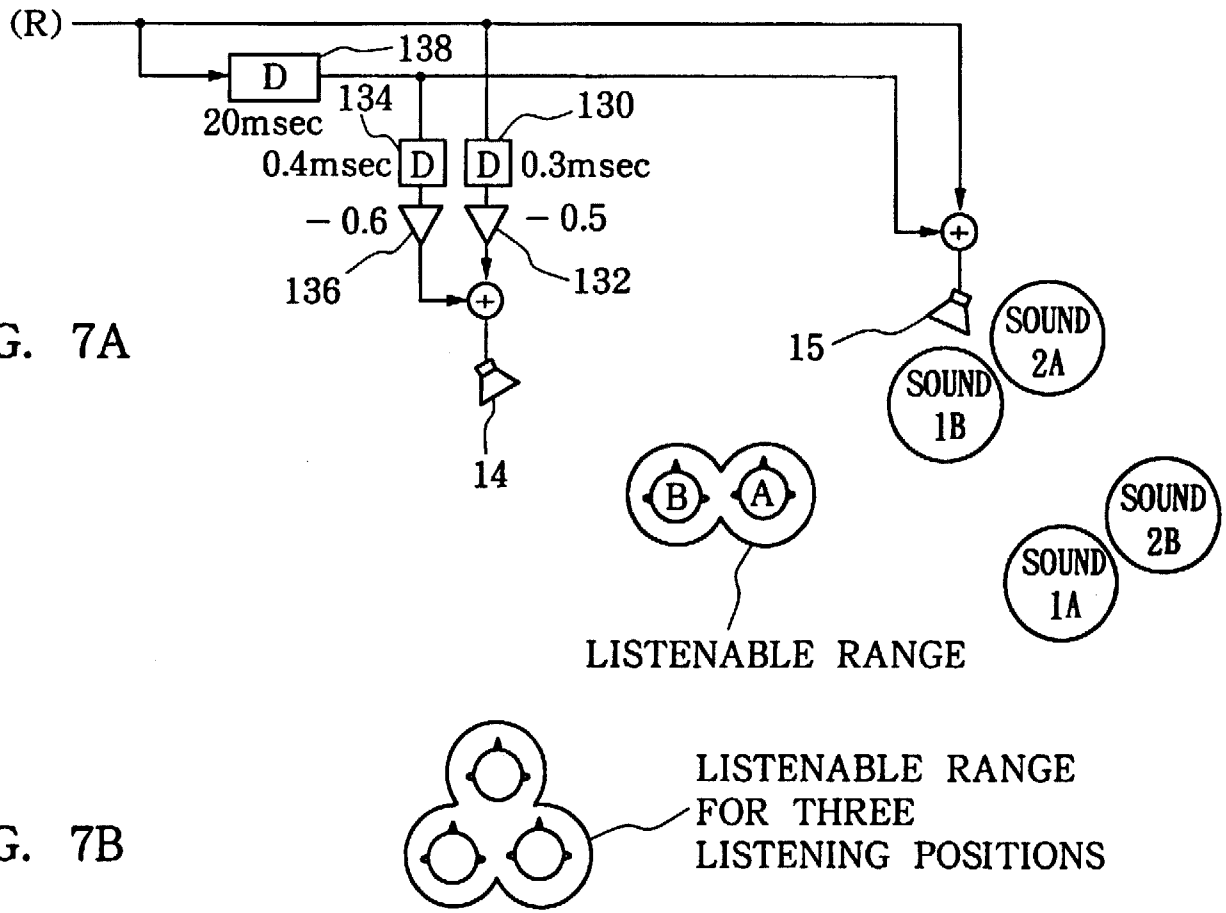
FIGS. 7A and 7B are diagrams for explaining the principle of the present invention.

Accordingly, by providing both the reproducing systems of FIGS. 6A and 6B, at least one sound image can be localized in a space outside of the speaker 15 regardless of whether the listener 12 is located at the listening position A or B. If, however, the reproducing systems of FIGS. 6A and 6B are simply combined, SOUND 1A and SOUND 2A (in case the listener 12 listens at the listening position A) or SOUND 1B and SOUND 2B (in case the listener 12 listens at the listening position B) are reproduced almost simultaneously to interfere with each other with the result that the cancelling effect is reduced and the outside-of-speaker localization becomes difficult. For preventing this, as shown in FIG. 7A, time lag is provided between SOUND 1 (A, B) and SOUND 2 (A, B) by means of a delay circuit 138 before these sounds are reproduced. As a result, the SOUND 1A and SOUND 2A (or SOUND 1B and SOUND 2B) have a function of reflected sounds localized at different positions. By further increasing listening positions and providing reproducing systems in which delay times and multiplication coefficients are adjusted so that the outside-of-speaker localization can be produced at respective listening positions and reproducing SOUND 1 and SOUND 2 with a time lag,. at least one sound image can be localized in a space outside of the speaker 15 regardless of which listening position the listener 12 may be located and, therefore, expansion of the listenable range (i.e,. the range in which the outside-of-speaker localization can be obtained) is realized. An example in which the listening position is located at three points is shown in FIG. 7B.

In the foregoing manner, by providing a plurality of listening positions at positions where the speakers 14 and 15 are located on the front left and front right sides of the listener in such a manner that their listenable ranges are arranged substantially side by side, determining delay times and multiplication coefficients of cancel signals so that an outside-of-speaker localization can be obtained for each of the listenable ranges (The delay times are particularly important for obtaining the outside-of-speaker localization. As to the multiplication coefficients, the outside-of-speaker localization effect can be obtained in some case even if the multiplication coefficients are determined uniformly, though a clearer outside-of-speaker localization can be obtained in case the multiplication coefficients are determined differently depending upon the listening positions.), and reproducing reflected sound signals and cancel signals therefor from the front left and front right speakers 14 and 15 with a time lag between the respective listening positions, feeling of expansion of reflected sounds can be obtained for a broad listenable range whereby feeling of a sound field of a concert hall etc. can be realized. Further, since reflected sounds with various delay times and multiplication coefficients are provided, there is an increased possibility of realization of an outside-of-speaker localization with respect to some of the reflected sounds and, therefore, the effect of difference in the ear characteristics between individuals can be mitigated.

The delay times of the cancel signals (i.e., delay times for the reflected sound signals) are determined within a range from 0 msec to 0.8 msec and the gain of the cancel signals (i.e., gain for the reflected sound signals) should preferably be within a range from −10 dB (0.3) to −1 dB (0.9). If the gain is less than −10 dB (i.e., the tone volume of the cancel signal is small), a sufficient cancelling effect cannot be obtained and hence feeling of expansion of the sound image in a space outside of the speakers cannot be produced. If the gain is larger than −1 dB (i.e., the tone volume of the cancel signal is large), the sound of the cancel signal remains in the speaker which has sounded the cancel signal no matter how the delay time is adjusted. The time lag which is given to each listening position reduces interference in the outside-of-speaker localization and also generates a reflected sound for producing a sound field. The time lag is set at a length of time which is much longer than the delay time of the cancel signal (e.g., over 5 msec and preferably over 20 msec).

The structure of the left side localized reflected sound generation circuit 126 and the right side localized reflected sound generation circuit 128 will now be described. In the left side localized reflected sound generation circuit 126, the input signal L+R is applied to a delay circuit 140 and is sequentially delayed by the delay circuit 140 by a predetermined clock and delay signals are provided from taps corresponding to delay times of respective left side reflected sounds to be generated (i.e., delay times to direct sounds) and imparted with multiplication coefficients for the respective reflected sounds by a coefficient generator 142 to adjust their level (tone volume). The reflected sound signals which have been adjusted in their level are added together by and adder 144 to form a left channel reflected sound signal Lr.

The reflected sound signals provided by the coefficient generator 142 are delayed by a delay circuit 146 by delay times set for the respective reflected sounds and are imparted with multiplication coefficients which are determined for the respective reflected sound signals and inverted in phase by a coefficient generator 148. On the basis of the principle described with reference to FIGS. 6 and 7, the delay times of the delay circuit 146 and the coefficient values of the coefficient generator 148 are determined to values at which an outside-of-speaker localization is provided with respect to the left channel speaker 14 at listening positions which are hypothetically established for the respective reflected sounds. The reflected sound signals provided by the coefficient generator 148 are added together by an adder 150 to form a left channel cancel signal Lc.

In the right side localized reflected sound generation circuit 128, the input signal L+R is applied to a delay circuit 152 and is sequentially delayed by the delay circuit 152 by a predetermined clock and delay signals are provided from taps corresponding to delay times of respective right side reflected sounds to be generated (i.e., delay times to direct sounds) and imparted with multiplication coefficients for the respective reflected sounds by a coefficient generator 154 to adjust their level (tone volume). The reflected sound signals which have been adjusted in their level are added together by and adder 156 to form a right channel reflected sound signal Rr.

The reflected sound signals provided by the coefficient generator 154 are delayed by a delay circuit 158 by delay times set for the respective reflected sounds and are imparted with multiplication coefficients which are determined for the respective reflected sound signals and inverted in phase by a coefficient generator 160. On the basis of the principle described with reference to FIGS. 6 and 7, the delay times of the delay circuit 158 and the coefficient values of the coefficient generator 160 are determined to values at which an outside-of-speaker localization is provided with respect to the right channel speaker 15 at listening positions which are hypothetically established for the respective reflected sounds. The reflected sound signals provided by the coefficient generator 160 are added together by an adder 182 to form a right channel cancel signal Rc.

The left channel main signal L (direct sound), the left channel front reflected sound signal FL1, the left channel reflected sound signal Lr and the right channel cancel signal Rc are added together by an adder 74 and a sum signal is converted to an analog signal by a digital-to-analog converter 78 and reproduced by the front left speaker 14 through a low-pass filter 78 and an amplifier 80.

The right channel main signal R (direct sound), the right channel front reflected sound signal R1, the right channel reflected sound signal Rr and the left channel cancel signal Lc are added together by an adder 82 and a sum signal is converted to an analog signal by a digital-to-analog converter 84 and reproduced by the front right speaker 15 through a low-pass filter 86 and an amplifier 88. A sound field can be effectively produced by using about eight reflected sounds for each channel (a larger or smaller number of reflected sounds may be used).

By the above described arrangement, the direct sound and the front reflected sounds are localized in a space between the speakers 14 and 15 while the left channel reflected sounds are localized in a space outside of the speaker 14 and the right channel reflected sounds are localized in a space outside of the speaker 15 whereby reproduction of tones with feeling of expansion of a sound field can be realized. Particularly, a sound field closely simulating a sound field of a concert hall or other environment can be reproduced by setting a reflected sound pattern (impulse response) of the sound field of a concert hall or other environment for the front, left side and right side respectively, setting the taps for providing delay outputs of the delay circuit 28 and the multiplication coefficients of the coefficient generators 30 and 32 of the front localized reflected sound generation circuit 26 so as to match the front reflected sound pattern, setting the taps for providing delay outputs of the delay circuit 140 and the multiplication coefficients of the coefficient generator 142 of the left side localized reflected sound generation circuit 126 so as to match the left side reflected sound pattern, and setting the taps for providing delay outputs of the delay circuit 152 and the multiplication coefficients of the coefficient generator 154 of the right side reflected sound generation circuit 128 so as to match the right side reflected sound pattern.

Since the delay time and multiplication coefficient of the cancel signal are variously set for the respective reflected sounds, a broad listenable range can be produced and the effect of difference in the ear characteristics between individuals can be mitigated so that all listeners can feel expansion of a sound field by the outside-of-speaker localization.

In the above described embodiment, the same signal is applied to the delay circuits 28, 140 and 152, these delay circuits 28, 140 and 152 may be combined to a single delay circuit (or the delay circuits 140 and 152 may be combined to a single circuit) and taps for providing delay signals may be increased to produce the reflected sound signals FR1, FL1, Rr and Lr and the cancel signals Rc and Lc.

Embodiment 2

Figure 8:
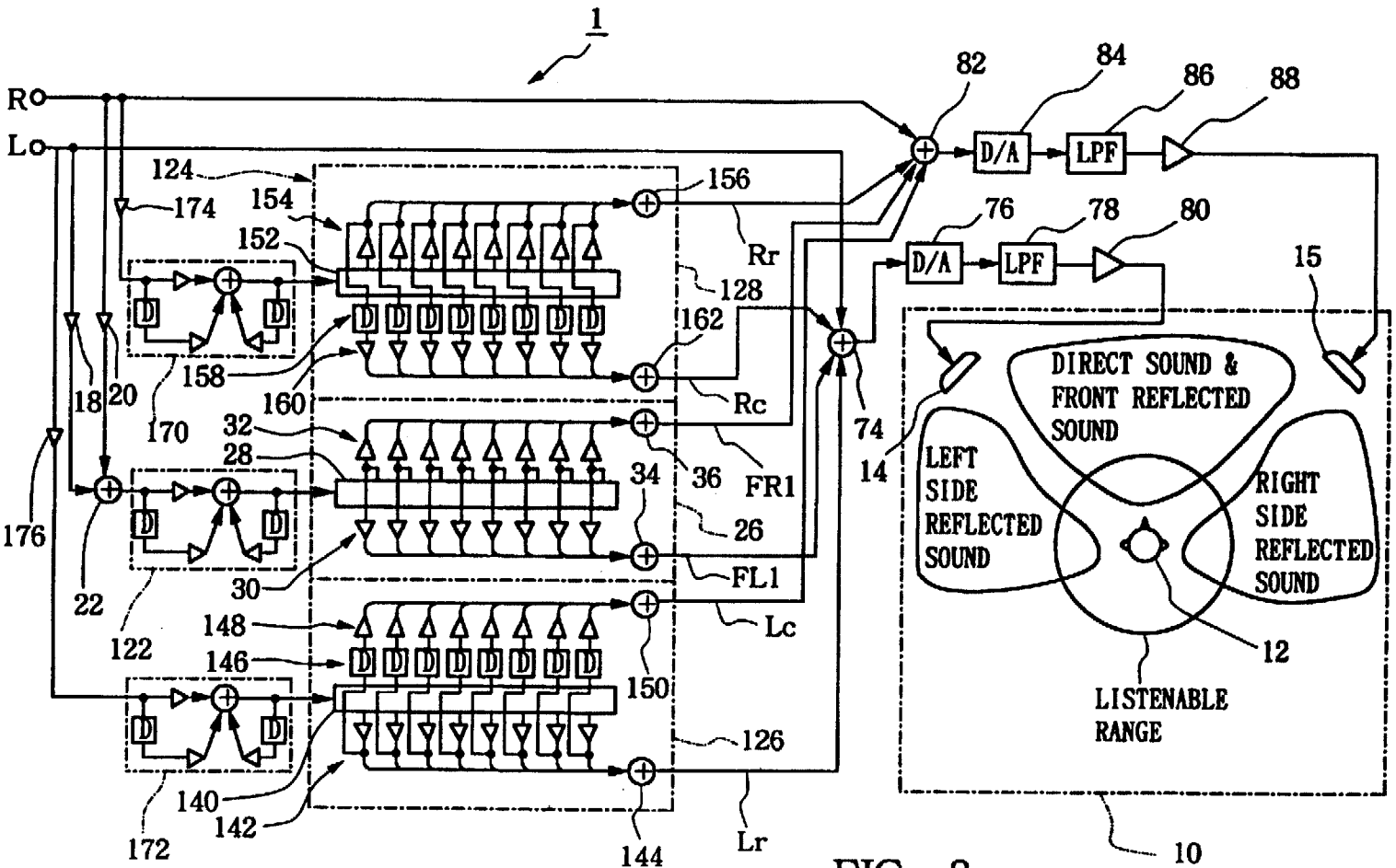
FIG. 8 is a block diagram showing another embodiment of the invention.

FIG. 8 shows another embodiment of the invention. In this embodiment, the left side localized reflected sound generation circuit 126 produces the left channel reflected sound signal Lr and the left channel cancel signal Lc on the basis of the left channel signal L only and the right side reflected sound generation circuit 128 produces the right channel reflected sound signal Rr and the right channel cancel signal Rc on the basis of the right channel signal R only. The same component parts as those of the embodiment of FIG. 1 are designated by the same reference characters. According to the embodiment of FIG. 8, a more intense feeling of expansion of a sound field can be obtained than by the embodiment of FIG. 1 in which the reflected sound signals and the cancel signals are produced on the basis of the sum signal L+R of the-left channel signal L and the right channel signal R. In the embodiment of FIG. 8, the low-pass filters 170 and 172 have the same characteristics as the low-pass filter 22. The gain of the coefficient generators 174 and 176 is set at a proper value.

Figure 9:
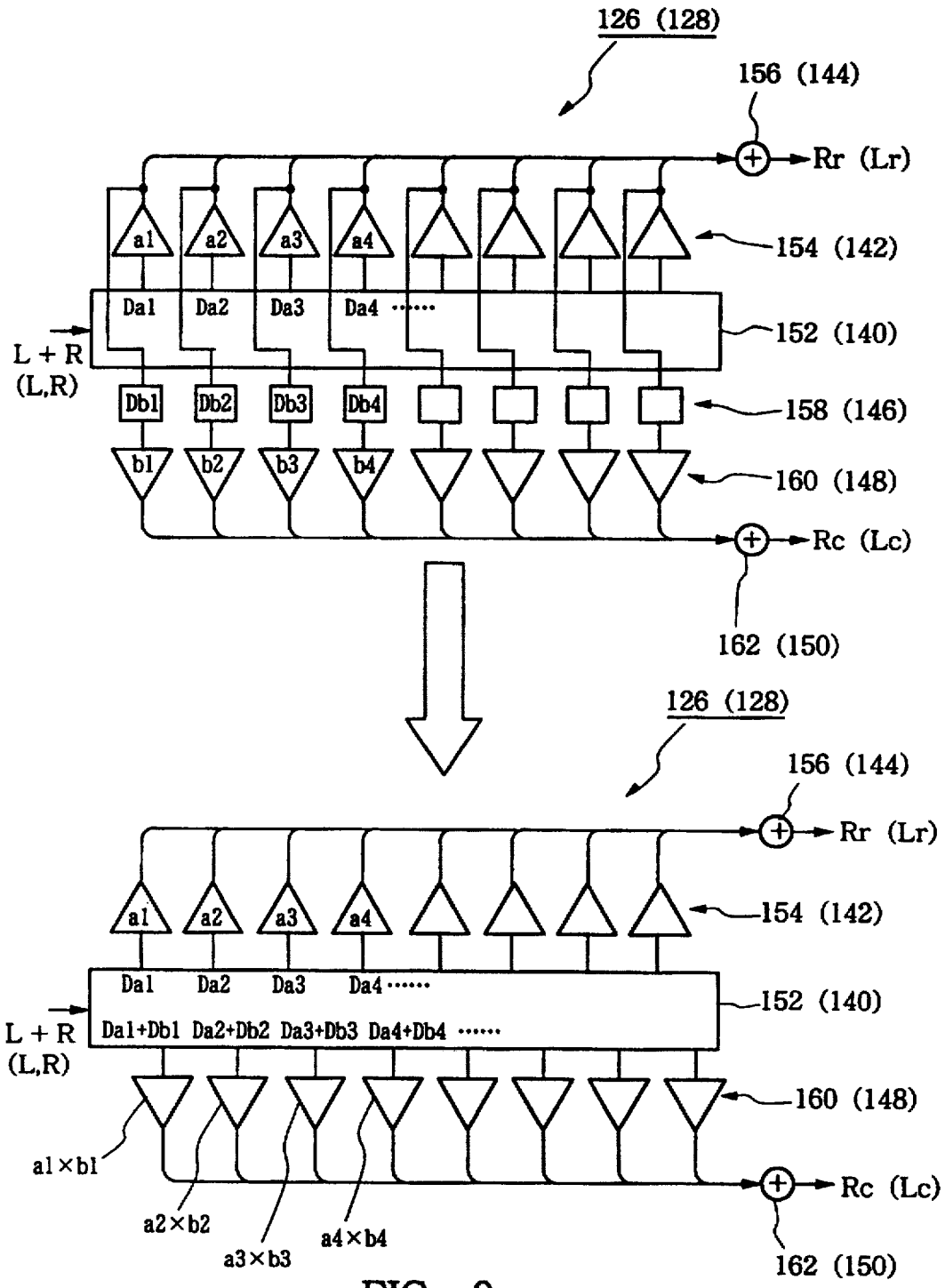
FIG. 9 is a diagram showing another example of the left channel localized reflected sound generation circuit and the right channel localized reflected sound generation circuit.

In the embodiments of FIGS. 1 and 8, the circuit design of the left side localized reflected sound generation circuit 126 and the right side localized reflected sound generation circuit 128 can be simplified by modifying the circuit to one shown in the lower stage of FIG. 9.

What is claimed is:

1. A stereophonic sound field expansion device comprising:

left channel reflected sound signal generation means for generating left channel reflected sound signals of an input tone signal having different delay times and different levels;

right channel reflected sound signal generation means for generating right channel reflected sound signals of an input tone signal having different delay times and different levels;

left channel cancel signal generation means for generating left channel cancel signals by delaying the left channel reflected sound signals individually with delay times which enable localization of the respective left channel reflected sound signals at different listening points determined for the respective left channel reflected sound signals in a space outside of a space in front of and between speakers and by inverting phase of the respective left channel reflected sound signals;

right channel cancel signal generation means for generating right channel cancel signals by delaying the right channel reflected sound signals individually with delay times which enable localization of the respective right channel reflected sound signals at different listening points determined for the respective right channel reflected sound signals in a space outside of a space in front of and between speakers and by inverting phase of the respective right channel reflected sound signals;

a left channel speaker provided on the front left side of a listening position of a listener for reproducing the left channel reflected sound signals and the right channel cancel signals; and a right channel speaker provided on the front right side of the listening position for reproducing the right channel reflected sound signals and the left channel cancel signals.

2. A stereophonic sound field expansion device as defined in claim 1 further comprising:

attenuation means for attenuating the left channel cancel signals with multiplication coefficients which enable a clearer localization of the respective left channel reflected sound signals at the respective listening points determined for the respective left channel reflected sound signals in the space outside of the space in front of and between the speakers and;

attenuation means for attenuating right channel cancel signals with multiplication coefficients which enable a clearer localization of the respective right channel reflected sound signals at the respective listening points determined for the respective right channel reflected sound signals in the space outside of the space in front of and between the speaker.

3. A stereophonic sound field expansion device as defined in claim 1 further comprising front reflected sound signal generation means for generating front reflected sound signals of an input signal having different delay times and different levels, said front reflected sound signals being reproduced by said left channel speaker and said right channel speaker.

4. A stereophonic sound field expansion device as defined in claim 1 further comprising input signal combining means for combining an input left channel tone signal and an input right channel tone signal together to form an input tone signal to be supplied to the left channel reflected sound signal generation means and the right channel reflected sound signal generation means.

5. A stereophonic sound field expansion device as defined in claim 1 wherein the input tone signal applied to said left channel reflected sound signal generation means is a left channel input tone signal and the input tone signal applied to said right channel reflected sound signal generation means is a right channel input tone signal.

6. A stereophonic sound field expansion device as defined in claim 3 further comprising input signal combining means for combining an input left channel tone signal and an input right channel tone signal together to form an input tone signal to be supplied to the left channel reflected sound signal generation means and the right channel reflected sound signal generation means.

7. A stereophonic sound field expansion device as defined in claim 3 wherein the input tone signal applied to said left channel reflected sound signal generation means is a left channel input tone signal and the input tone signal applied to said right channel reflected sound signal generation means is a right channel input tone signal.

8. A stereophonic sound field expansion device as defined in claim 3 wherein the front reflected sound signals to be reproduced by the left channel speaker have the same delay time as the front reflected sound signals to be reproduced by the right channel speaker and have a different level from the front reflected sound signals to be reproduced from the right channel speaker.

* * * * *